US007833051B2

(12) United States Patent
Huang et al.

(10) Patent No.: US 7,833,051 B2
(45) Date of Patent: Nov. 16, 2010

(54) INTEGRATED CONNECTING PORT MODULE AND ELECTRONIC DEVICE EQUIPPED WITH THE SAME

(75) Inventors: Jiang-Wen Huang, Taipei (TW); Pai-ching Huang, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 70 days.

(21) Appl. No.: 12/252,788

(22) Filed: Oct. 16, 2008

(65) Prior Publication Data

US 2009/0130866 A1 May 21, 2009

(30) Foreign Application Priority Data

Nov. 16, 2007 (TW) ..... 96143616 A

(51) Int. Cl.
*H01R 13/60* (2006.01)

(52) U.S. Cl. ..... 439/541.5; 439/638; 439/540.1; 439/79

(58) Field of Classification Search ..... 439/540.1, 439/541.5, 638, 79

See application file for complete search history.

(56) References Cited

U.S. PATENT DOCUMENTS 7,090,538 B1 8/2006 Huang
2007/0232131 A1* 10/2007 Ju ..... 439/541.5

FOREIGN PATENT DOCUMENTS

CN 2768246 3/2006
CN 20106051 5/2008

* cited by examiner

*Primary Examiner*—Tho D Ta
(74) *Attorney, Agent, or Firm*—Muncy, Geissler, Olds & Lowe, PLLC

(57) ABSTRACT

An integrated connecting port module is suitable for an adapter having one terminal which is a High Definition Multimedia Interface (HDMI) adapting port and the other terminal which is a Digital Visual Interface (DVI) adapting port. The integrated connecting port module includes a case, an HDMI port and at least one expansion port. The case has a width not smaller than that of the DVI adapting port. The HDMI port and the expansion port are installed on the case and are stacked. An electronic device including the integrated connecting port module is also disclosed.

10 Claims, 6 Drawing Sheets

INTEGRATED CONNECTING PORT MODULE AND ELECTRONIC DEVICE EQUIPPED WITH THE SAME

CROSS REFERENCE TO RELATED APPLICATIONS

This Non-provisional application claims priority under 35 U.S.C. §119(a) on Patent Application No(s). 096143616 filed in Taiwan, Republic of China on Nov. 16, 2007, the entire contents of which are hereby incorporated by reference.

BACKGROUND OF THE INVENTION

1. Field of Invention

The invention is related to a connecting port module and, more specifically, to an integrated module with a plurality of connecting ports and an electronic device equipped with the integrated module.

2. Related Art

The electronic device such as the main board, computer, or LCD TV usually has various types of connecting ports for matching connectors with different standards for establishing the desired connection.

As shown in FIG. 1, a plurality of 3.5 mm stereo jacks 12, a high definition multimedia interface (HDMI) port 13, and a plurality of universal serial bus (USB) ports 14 are installed on a circuit board 11. Because the mechanical standard (e.g. the interface width) of the HDMI port 13 is smaller, the adjacent 3.5 mm stereo jacks 12 or USB ports 14 are not blocked or interfered when a standard HDMI adapter is inserted.

Since the signal transmissions of the digital visual interface (DVI) and the HDMI both follow the transition minimized differential signaling (TMDS) transmission protocol, the signals from the DVI and from the HDMI can be adapted through an interface converter 2. When a user inserts the interface converter 2, in which one terminal is an HDMI adapting port 21 and the other terminal is a DVI adapting port 22, to the HDMI port 13 on the circuit board 11, because the width W1 of the DVI port is larger than the width W2 of the HDMI port and the interface converter 2 is used to connect a smaller interface to a larger one, the interface converter 2 will partially block the adjacent 3.5 mm stereo jacks 12 or USB ports 14. Thus, the blocked or interfered ports 12 and 14 cannot be used conveniently. Moreover, other connectors may not even be inserted into the ports 12 and 14, so that these ports 12 and 14 cannot be used.

SUMMARY OF THE INVENTION

An object of the invention is to provide an integrated connecting port module that is able to prevent the interference between the connecting ports, and an electronic device equipped with the integrated connecting port module.

An integrated connecting port module of the invention is suitable to an interface converter having a terminal being a high definition multimedia interface (HDMI) adapting port and the other terminal being a digital visual interface (DVI) adapting port. The integrated connecting port module includes a case, an HDMI port, and at least one expansion port. The case has a width not smaller than that of the DVI adapting port. The HDMI port and the expansion port are installed on the case and stacked.

An electronic device of the invention is suitable to an interface converter having a terminal being an HDMI adapting port and the other terminal being a DVI adapting port. The electronic device includes a circuit board and an integrated connecting port module, which includes a case, an HDMI port, and an expansion port. The case has a width larger than or equal to that of the DVI adapting port. The HDMI port and the expansion port are stacked and installed on the case, and the integrated connecting module is installed on the circuit board.

As described above, the case width of the integrated connecting port module of the invention is larger than or equal to the width of the DVI adapting port. Accordingly, besides the HDMI port, the integrated connecting port module has a sufficient space for connecting with an interface converter so as to convert the HDMI to the DVI. In addition, the interface converter connecting to the HDMI port will not spatially block or interfere with other expansion port, expander, or connector.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
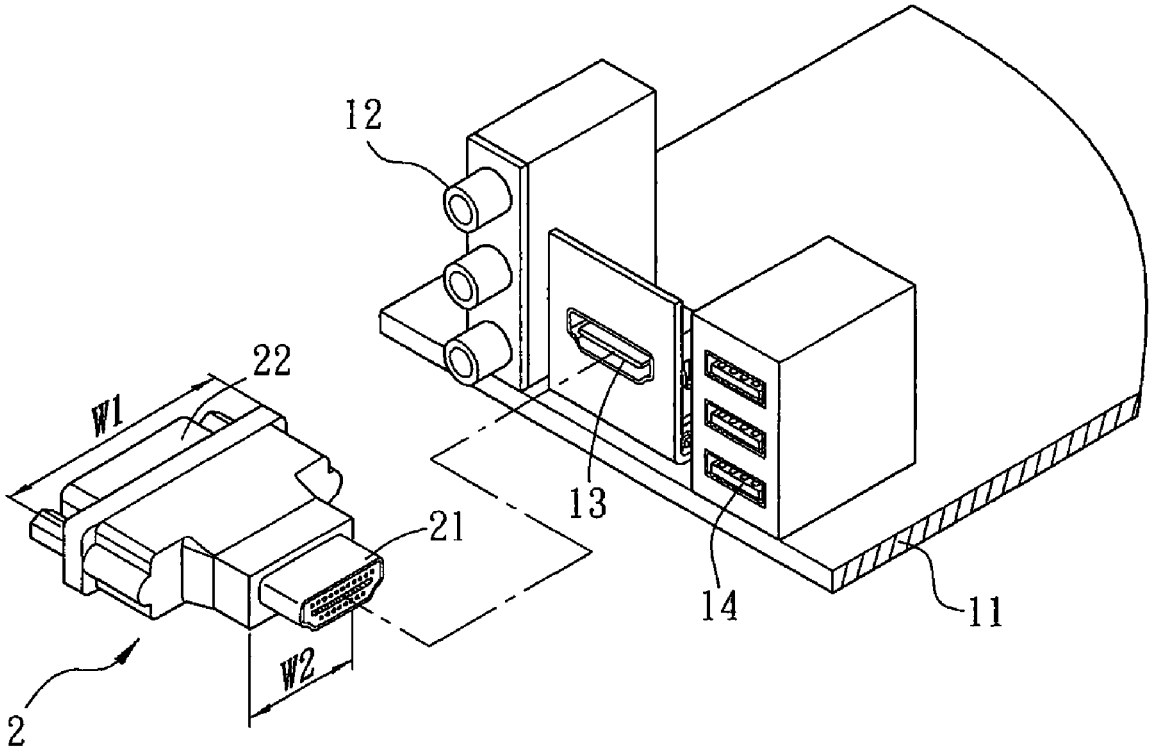
FIG. 1 (Prior Art)
FIG. 1 is a schematic diagram of the conventional art showing that a circuit board has a plurality of connecting ports.
Figure 2:
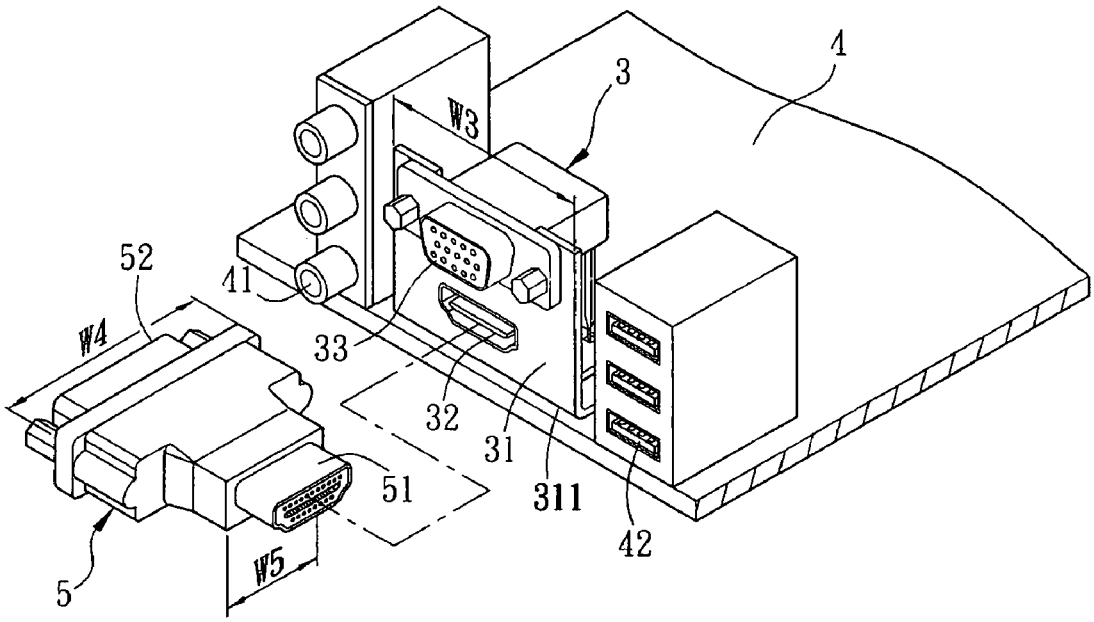
FIG. 2 is a schematic diagram of an integrated connecting port module and an interface converter according to a preferred embodiment of the invention.
Figure 3:
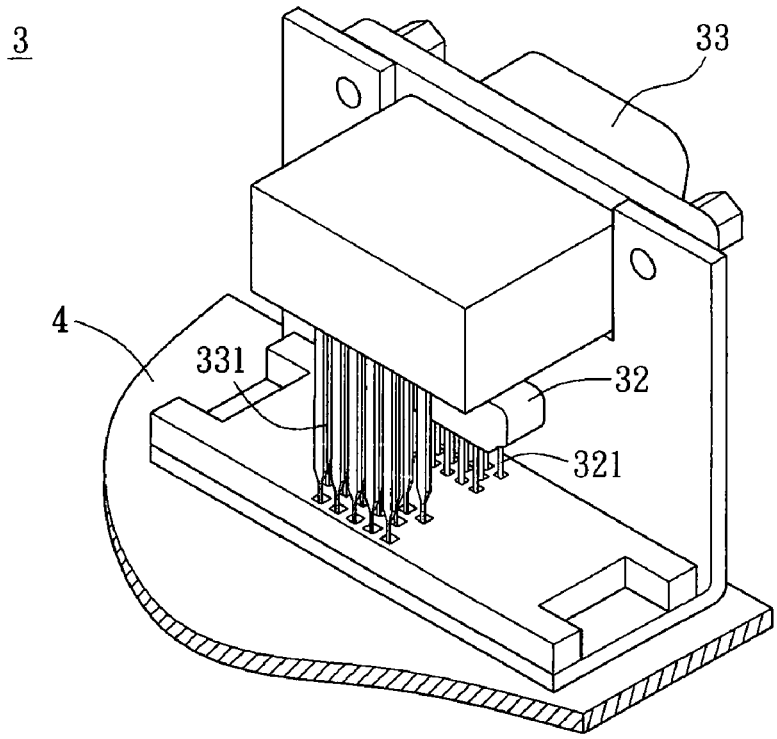
FIG. 3 is a schematic diagram of the back pins of the integrated connecting port module according to a preferred embodiment of the invention.

As shown in FIGS. 2 and 3, a plurality of 3.5 mm stereo jacks 41, an integrated connecting port module 3, and a plurality of universal serial bus (USB) ports 42 are installed on a circuit board 4. The circuit board 4 has signal lines (not shown) to electrically connect with the 3.5 mm stereo jacks 41, integrated connecting port module 3, and USB ports 42.

In addition, the integrated circuits (IC) or chips such as the microprocessor, micro controller, RAM, power management chip, graphic processing unit, communication control chip (e.g. USB, IEEE 1394, ATA, IEEE 802.x), or application-specific integrated circuit (ASIC) (not shown) may also be installed on the circuit board 4. These ICs or chips are connected to each other, as well as to the 3.5 mm stereo jacks 41, the integrated connecting port module 3, and the USB ports 42, through the signal lines on the circuit board 4 so as to output the processed results or receive data from the outside. In this embodiment, the circuit board 4 may be a main board of an arithmetic device (e.g. electronic devices such as a computer, projector, portable communication device, or video game station).

The integrated connecting port module 3 that is installed on the circuit board 4 includes a case 31, an HDMI port 32, and an expansion port 33. The case 31 has a bottom 311, through which the case 31 may be fixed to the circuit board 4. In the embodiment, the HDMI port 32 and expansion port 33 are parallel with each other and stacked over the case 31, and the HDMI port 32 is located between the bottom 311 and the expansion port 33.

An interface converter 5 converts the signal outputted from the HDMI port 32 to another video standard. In the embodiment the video standard is a DVI standard, so that one terminal of the interface converter 5 is an HDMI adapting port 51 and the other is a DVI adapting port 52.

Additionally, in order to make sure that the interface converter 5 connected to the HDMI port 32 will not block or interfere with the adjacent ports, the width W3 of the case 31 of the integrated connecting port module 3 is larger than or equal to the width W4 of the DVI adapting port 52. As the interface converter 5 is connected to the HDMI port 32 of the integrated connecting port module 3, since the width W4 of the interface converter 5 is smaller than or equal to the width W3 of the integrated connecting port module 3, the stereo jacks 41 and the USB ports 42 adjacent to the integrated connecting port module 3 will not be blocked or interfered.

In addition, the frequency is a factor to be considered when it comes to the disposition of the HDMI port 32 and expansion port 33. Practically, in order to prevent the attenuation of the high frequency signal, the port for transmitting such has to be closer to the circuit board 4. The port for transmitting the low frequency signal can be farther to the circuit board 4. Since the HDMI port 32 needs to transmit a large amount of video data, the signal transmission frequency thereof is usually high. In addition to the demand for better image quality, the amount of data transfer for each video standard has gone up in recent years, which leads to a higher signal transmission frequency of the HDMI port 32. Therefore, compared to the expansion port 33, the HDMI port 32 may be disposed to a position closer to the circuit board 4, i.e. under the integrated connecting port module 3, and the expansion port 33 with a lower transmission frequency is disposed to a position over the HDMI port 32.

In the embodiment, because the transmission frequency of the HDMI is in GHz, the HDMI port 32 is disposed to a position closer to the circuit board 4. The expansion port 33 with a lower transmission frequency may be disposed over the HDMI port 32. For example, the expansion port 33 can be a conventional VGA port as shown in FIG. 2. The expansion port 33 disposed over the HDMI port 32 can also be any of other standards such as D-sub terminal, IEEE 1394, IEEE 802.x, SATA, PS2, and 3.5 mm stereo jack. Besides, the 3.5 mm stereo jack 41 and USB port 42 are not the limited standards, and other standards such as D-sub terminal, IEEE 1394, IEEE 802.x. SATA, and PS2 shall be included in the scope of the invention.

As shown in FIG. 3, the pins 321 and 331 of the HDMI port 32 and expansion port 33, respectively, may be directly extended to the circuit board 4 so as to electrically connect to the circuits on the circuit board 4 (not shown). Accordingly, the signals on the circuit board 4 will be transmitted to the connector and/or interface converter 5 through the expansion port 33.

Figure 4A:
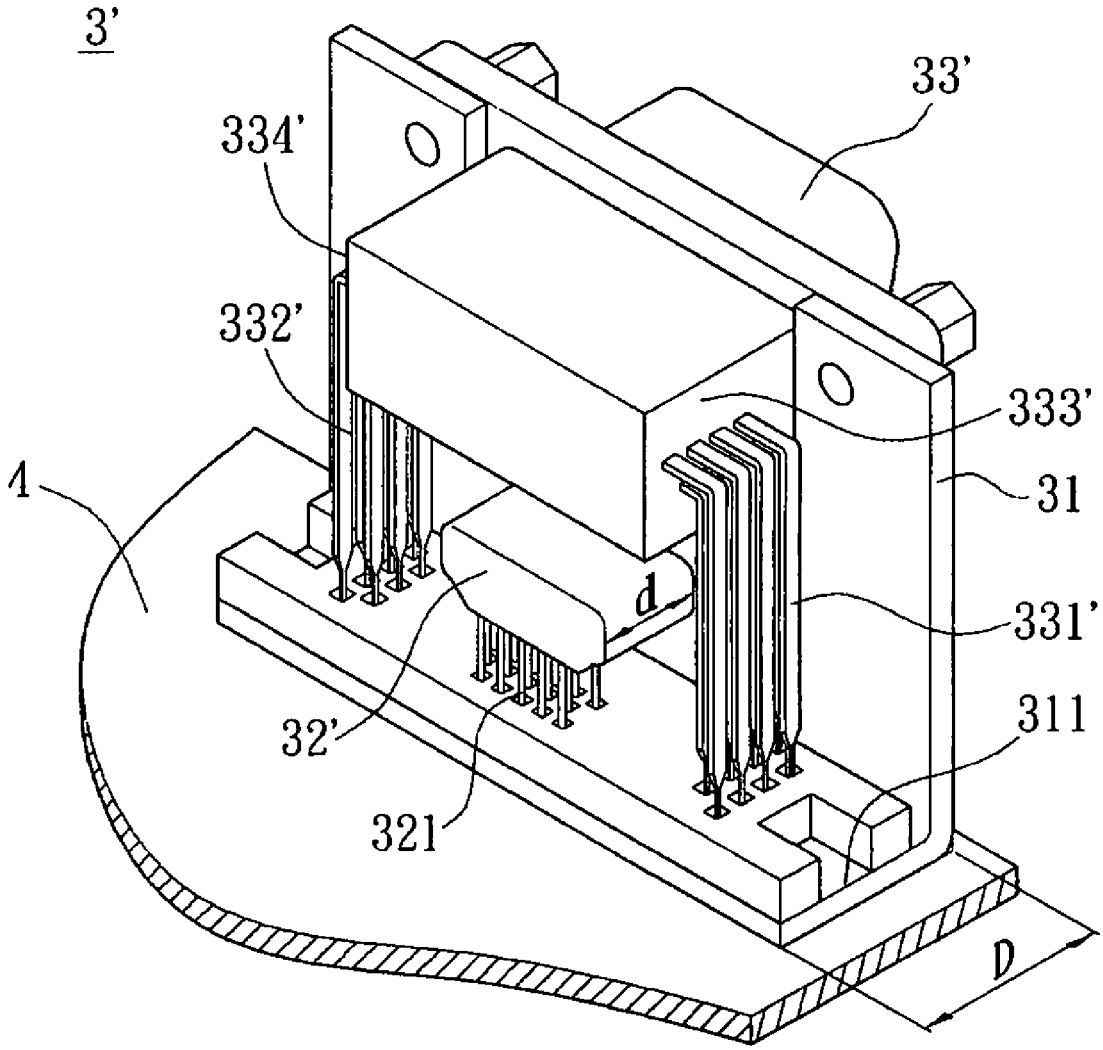
FIGS. 4A and 4B are schematic diagrams of another aspect of the back pins of the integrated connecting port module according to a preferred embodiment of the invention.

Additionally, as shown in FIG. 4A, to further save more space on the circuit board 4 that may be needed for the integrated connecting port module 3, in the embodiment, two groups of pins 331' and 332' are extended from two side surfaces of the expansion port 33' in the direction parallel with the bottom 311 and then bended downward to electrically connect with the circuit board 4.

Figure 4B:
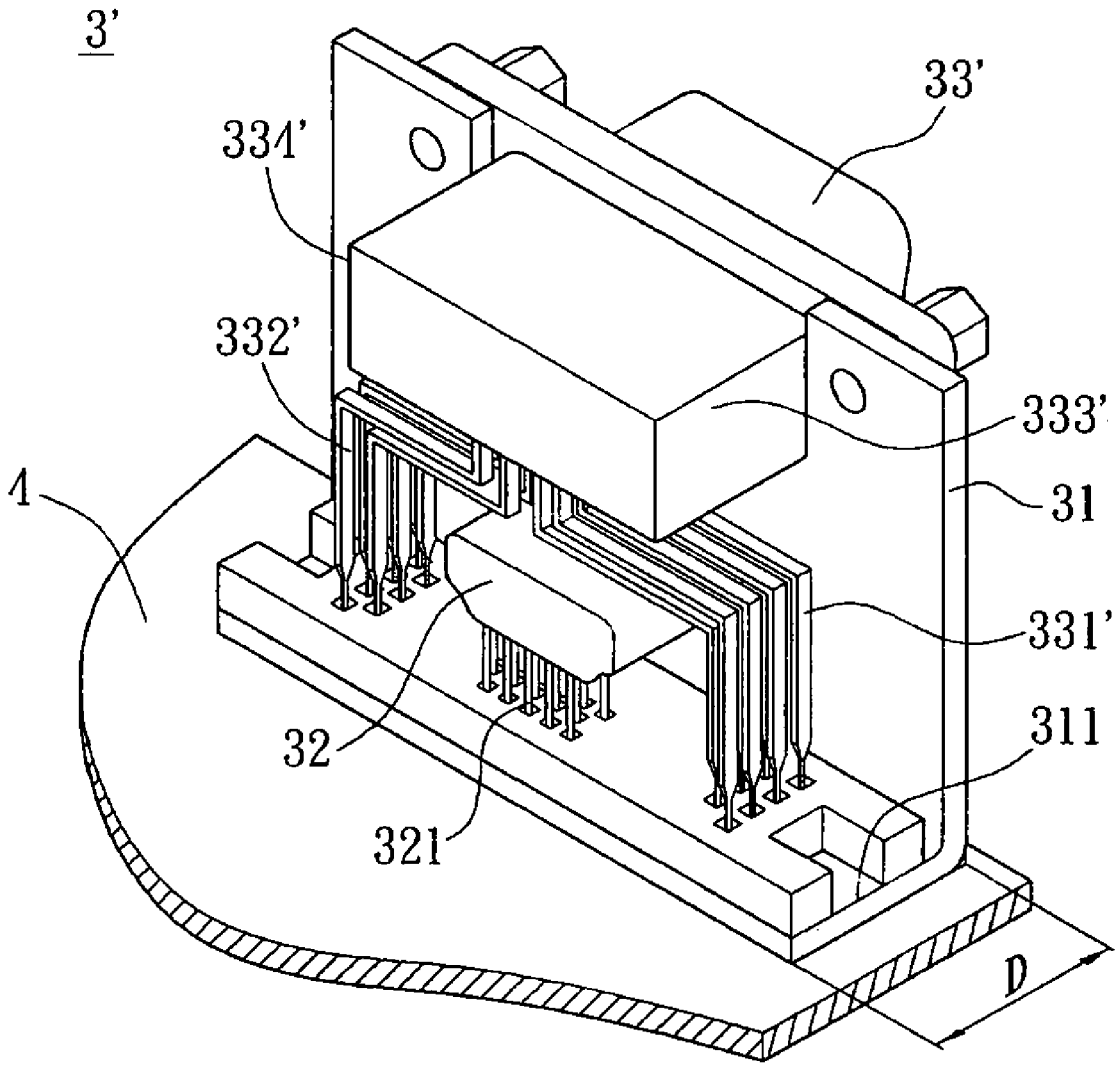

Moreover, another aspect of the extended direction of the pins is shown in FIG. 4B. Two groups of pins 331' and 332' are extended from the bottom of the expansion port 33', then bended and extended along the direction parallel with the top of the HDMI port 32. After that, the extended part that exceeds the top of the HDMI port 32 is bended downward to electrically connect with the circuit board 4.

In addition, another aspect of the extended direction of the pins 331' and 332' is that the pins may be directly extended from the bottom of the expansion port 33' along the HDMI port 32 and case 31 to connect with the circuit board 4 (not shown). Similarly, the two groups of the pins 331' and 332' go around the HDMI port 32, respectively.

The above-mentioned three aspects of the pins are able to reduce the thickness D of the expansion port 33' and integrated connecting port module 3', and the space that is contiguous with the sides of HDMI port 32 may be effectively used so as to reduce the area needed on the circuit board 4 for the expansion port 33' and the integrated connecting port module 3'. Hence the layout of the circuit board 4 may be efficiently deployed. The number of the pins 331' and 332' may be disposed depending on the width d of the side of the HDMI port 32. The rows of the pins 331' and 332' may be increased if necessary so that the thickness D of the integrated connecting port module 3' will be effectively decreased.

Figure 5:
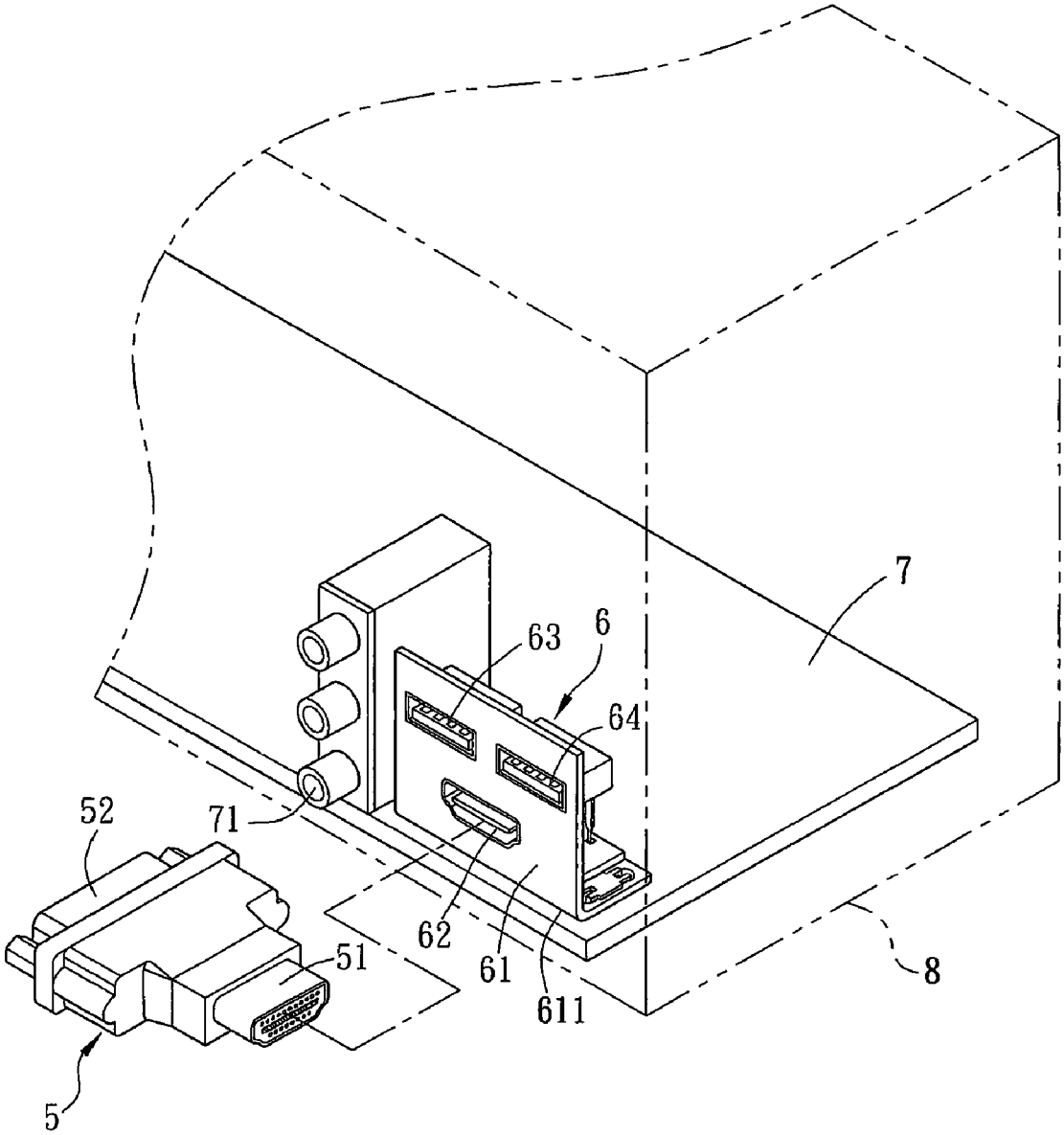
FIG. 5 is a schematic diagram of the electronic device with the integrated connecting port module according to a preferred embodiment of the invention.

FIG. 5 is a schematic diagram of an electronic device 8 with the integrated connecting port module according to a preferred embodiment of the invention. As shown in FIG. 5, the electronic device 8 includes an integrated connecting port module 6 and a circuit board 7. The circuit board 7 has the same function and technical characteristics as the circuit board 4 of the previous embodiment, so the detailed description thereof will be omitted. The electronic device 8 of the embodiment may be a portable electronic device, a projector, a computer, or a video game station.

The integrated connecting port module 6 that is installed on the circuit board 7 includes a case 61, an HDMI port 62, and an expansion port 63. The case 61 may have a bottom 611, through which the case 61 is fixed to the circuit board 7. In the integrated connecting port module 6, a plurality of the expansion ports 63 and 64, such as the USB port, PS2, IEEE 1394, IEEE 802.x, 3.5 mm stereo output, or D-sub terminal, may be installed over the HDMI port 62. In FIG. 5, the expansion ports 63 and 64 are, for example, USB ports.

In the direction perpendicular to the bottom 611 of the case 61, the HDMI port 62 and expansion ports 63 and 64 are disposed interlaced. In other words, the HDMI port 62 is located corresponding to the interval between the expansion ports 63 and 64.

When one terminal of the interface converter 5 is matching the HDMI adapting port 51 and the other is matching the DVI adapting port 52, after the HDMI adapting port 51 and HDMI port 62 are linked, the entire width of the interface converter 5 is exactly the width of the case 61. Thus the later use of the adjacent parts such as the 3.5 mm stereo jack 71 will not be affected.

Figure 6:
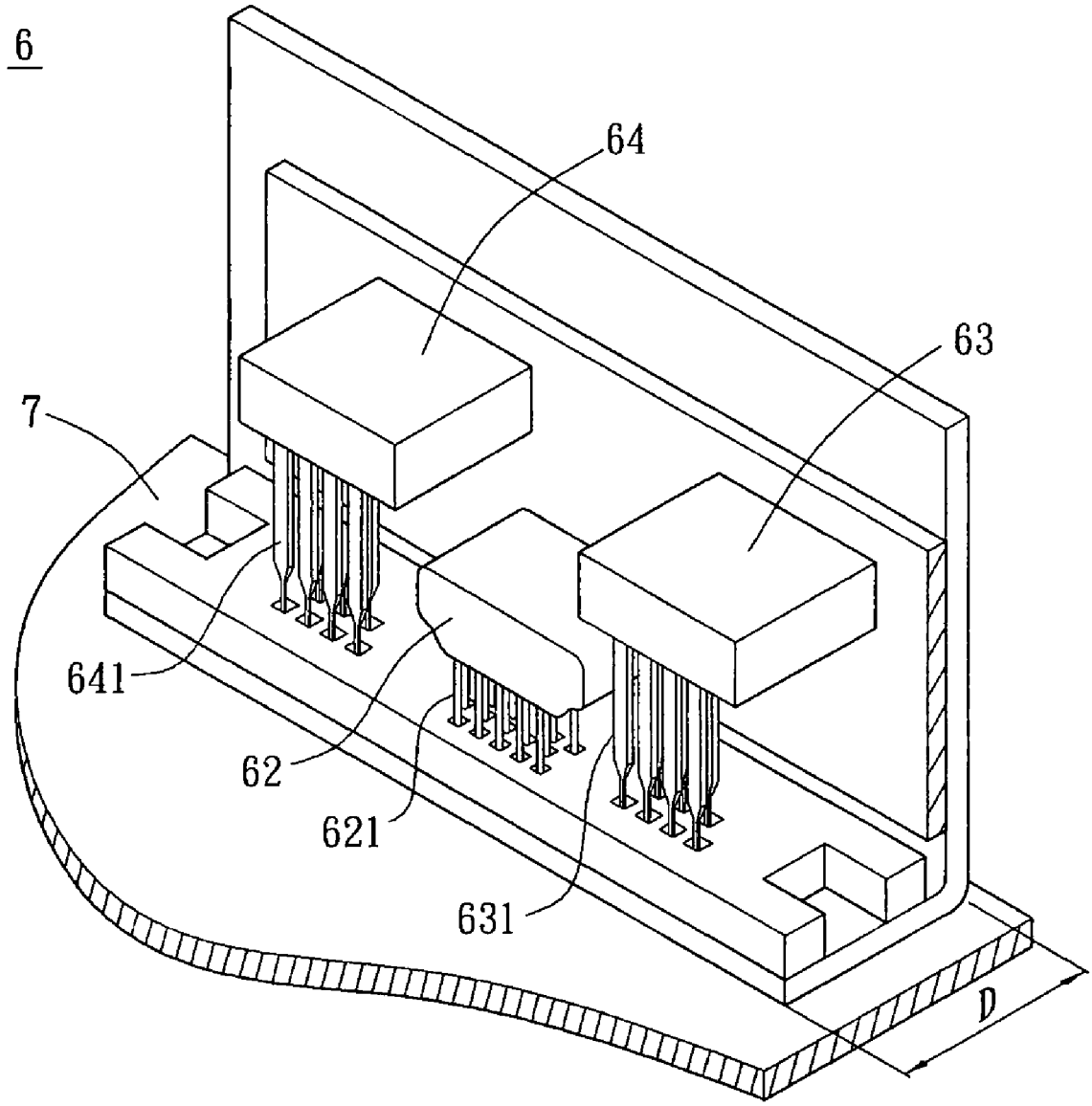
FIG. 6 is a schematic diagram of the back pins of the integrated connecting port module according to another preferred embodiment of the invention.

FIG. 6 is a schematic back view of the integrated connecting port module 6 in FIG. 5. The expansion ports 63 and 64 have multiple pins 631 and 641, respectively. The pins 631 and 641 may be directly extended from the lower surface of the expansion ports 63 and 64 along the case 61 and connected to the circuit board 4. They go around the HDMI port 62, respectively. Therefore, not only the space over the HDMI port 62 may be used to install more expansion ports 63 and 64, and the space around the HDMI port 62 may also be used to contain the pins 631 and 641 of the expansion ports 63 and 64. Thus, the thickness D of the integrated connecting port module 6 may be reduced so as to effectively deploy the layout of the circuit board 7. Furthermore, the pins 631 and 641 and the pin 621 of the HDMI port 62 can be any of various aspects illustrated in the previous embodiments of FIGS. 3, 4A, and 4B, so the detailed description thereof will be omitted.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An integrated connecting port module comprising:

a case having a width not smaller than that of a digital visual interface (DVI) adapting port;

a high definition multimedia interface (HDMI) port installed on the case; and at least one expansion port installed on the case;

wherein the HDMI port and the expansion port are stacked, wherein the HDMI port and the expansion port have a plurality of pins, respectively, and the pins of the HDMI port are extended downward to and electrically connect with a circuit board, and the pins of the expansion port are extended downward to and along a side edge of the HDMI port to electrically connect with the circuit board.

2. The integrated connecting port module according to claim 1, wherein the case has a bottom and the HDMI port is located between the bottom and the expansion port.

3. The integrated connecting port module according to claim 1, wherein the expansion port is a universal serial bus (USB) port, a PS2, an IEEE 1394, an IEEE802.x, a 3.5 mm stereo jack, or a D-sub terminal.

4. The integrated connecting port module according to claim 1, wherein the integrated connecting port module comprises a plurality of the expansion ports.

5. An electronic device suitable for an adapter having one terminal being a high definition multimedia interface (HDMI) adapting port and the other terminal being a digital visual interface (DVI) adapting port, the electronic device comprising:

a circuit board; and an integrated connecting port module comprising:

a case having a width not smaller than that of the DVI adapting port, an HDMI port installed on the case, and at least one expansion port installed on the case;

wherein the HDMI port and the expansion port are stacked and the integrated connecting port module is disposed on the circuit board, wherein the HDMI port and the expansion port have a plurality of pins, respectively, and the pins of the HDMI port are extended downward to and electrically connect with a circuit board, and the pins of the expansion port are extended downward to and along a side edge of the HDMI port to electrically connect with the circuit board.

6. The electronic device according to claim 5, wherein the case has a bottom and the HDMI port is located between the bottom and the expansion port.

7. The electronic device according to claim 5, wherein the expansion port is a USB port, a PS2, an IEEE 1394, an IEEE802.x, a 3.5 mm stereo jack, or a D-sub terminal.

8. The electronic device according to claim 5, wherein the integrated connecting port module comprises a plurality of expansion ports.

9. An integrated connecting port module comprising:

a case having a width not smaller than that of a digital visual interface (DVI) adapting port;

a high definition multimedia interface (HDMI) port installed on the case; and at least one expansion port installed on the case;

wherein the HDMI port and the expansion port are stacked, wherein the HDMI port and the expansion port have a plurality of pins, respectively, and the pins of the HDMI port are extended downward to and electrically connect with a circuit board, and the pins of the expansion port are extended from two side surfaces of the expansion port and are bended downward to electrically connect with the circuit board.

10. An electronic device suitable for an adapter having one terminal being a high definition multimedia interface (HDMI) adapting port and the other terminal being a digital visual interface (DVI) adapting port, the electronic device comprising:

a circuit board; and an integrated connecting port module comprising:

a case having a width not smaller than that of the DVI adapting port, an HDMI port installed on the case, and at least one expansion port installed on the case;

wherein the HDMI port and the expansion port are stacked and the integrated connecting port module is disposed on the circuit board, wherein the HDMI port and the expansion port have a plurality of pins, respectively, and the pins of the HDMI port are extended downward to and electrically connect with a circuit board, and the pins of the expansion port are extended from two side surfaces of the expansion port and are bended downward to electrically connect with the circuit board.

* * * * *